US008246135B2

(12) United States Patent
Han et al.

(10) Patent No.: US 8,246,135 B2
(45) Date of Patent: Aug. 21, 2012

(54) HEADCHIP AND HEAD FOR ARRAY TYPE INKJET PRINTER

(75) Inventors: Eun-bong Han, Suwon-si (KR); Nam-kyun Kim, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1280 days.

(21) Appl. No.: 11/958,508

(22) Filed: Dec. 18, 2007

(65) Prior Publication Data

US 2008/0278539 A1 Nov. 13, 2008

(30) Foreign Application Priority Data

May 8, 2007 (KR) ..... 10-2007-0044590

(51) Int. Cl.
*B41J 29/38* (2006.01)

(52) U.S. Cl. ..... 347/12; 347/15

(58) Field of Classification Search ..... 347/9–12, 347/15

See application file for complete search history.

(56) References Cited

U.S. PATENT DOCUMENTS 6,712,445 B2 * 3/2004 Yonekubo ..... 347/19
8,033,627 B2 * 10/2011 Hoshiyama et al. ..... 347/10
8,052,240 B2 * 11/2011 Kondoh ..... 347/9

* cited by examiner

*Primary Examiner* — Lamson Nguyen
(74) *Attorney, Agent, or Firm* — Stanzione & Kim, LLP

(57) ABSTRACT

A headchip and a head of an array type inkjet printer. The headchip of the array type inkjet printer according to an exemplary embodiment of the present general inventive concept includes an ink supply unit which is arranged into first nozzle groups and second nozzle groups according to colors, and a power supply unit to supply power to the plurality of first and second nozzle groups in an alternate order, in which the first and second nozzle groups for one color and the first and second nozzle groups for another color closest in proximity to the one color, are connected using one power line. Accordingly, a voltage drop may be avoided when the plurality of nozzles are driven at the same time.

18 Claims, 8 Drawing Sheets

HEADCHIP AND HEAD FOR ARRAY TYPE INKJET PRINTER

CROSS-REFERENCE TO RELATED APPLICATIONS

This application claims priority under 35 U.S.C. §119(a) from Korean Patent Application No. 10-2007-0044590, filed on May 8, 2007, in the Korean Intellectual Property Office, the disclosure of which is incorporated herein by reference in its entirety.

BACKGROUND OF THE INVENTION

1. Field of the Invention

The present general inventive concept relates to a headchip and a head for an array type inkjet printer. More particularly, the present general inventive concept relates to a headchip and a head for an array type inkjet printer, having a power wiring formed such that a plurality of colors share the power line.

2. Description of the Related Art

An inkjet printer ejects ink droplets onto a printing medium such as paper or film through nozzles to print images by pasting the ink onto the printing medium. The inkjet printer is divided into a shuttle type inkjet printer and an array type inkjet printer according to a driving method of a head for printing.

The shuttle type inkjet printer includes a plurality of nozzles on a head. The head moves in a scanning direction, printing a line, and moves a printing medium in a sub scanning direction, printing another line.

The array type inkjet printer includes a plurality of nozzles arranged along a scanning direction of a head printing lines one by one, and moves a printing medium in a sub scanning direction such that a following line is printed. Accordingly, an array type inkjet printer can print a width of the printing medium at once.

The array type inkjet printer includes a plurality of headchips which transfer ink using nozzles, and a structure of the head is extended to print as much as the width of a printing medium at once. The head structure of the array type inkjet printer is illustrated in FIGS. 1 and 2.

FIG. 1 is a view illustrating a head structure of a conventional array type inkjet printer, in which four headchips 10 are arranged on an array head 1.

As illustrated, the array head 1 may include an ink cartridge 20 to supply ink to the headchip 10, a substrate 30 which is electrically connected to a main body to supply power and a driving signal, an encapsulation bonding unit 40 to protect electrically a connection portion between the substrate 30 and the headchip 10, and a connection terminal 50 to be connected with the main body.

The encapsulation bonding unit 40 is formed using a bond such that a height of the encapsulation bonding unit 40 is above that of a nozzle layer of the headchip 10. Accordingly, a wiping operation is performed in a length direction of the array head 1 as indicated by an arrow A to remove dirt from an upper portion of the headchip 10.

Since the array type inkjet printer is used for high-speed printing, wiping time has to be short. However, since the wiping operation is performed in a length direction of the array head 1, the wiping operation takes a relatably long time during printing.

FIG. 2 is a view illustrating a structure of the headchip of FIG. 1.

FIG. 2 illustrates a structure of the headchip 10 that can discharge four colors of ink disposed on the array head 1 (FIG. 1). Referring to FIG. 2, a supplying pad 12 to receive power and a driving signal is provided at left and right sides of the headchip 10. A driving circuit 14, and a heater and ink passage 16 are arranged respectively in a length direction of the headchip 10.

When the array head 1 includes the headchip 10 having the above-described structure, wiring connecting the main body and each headchip 10 on the substrate 30 should be formed as a single body to supply power and the driving signal to each headchip 10.

If the headchip 10 is defective, it is almost impossible to repair the headchip 10. In particular, even if only one of the plurality of headchips 10 an entire array head 1 has to be changed.

Furthermore, since the supplying pads 12 to supply power and the driving signal is formed at both ends of the driving circuit 14 and the heater and the ink passage 16, and the power lines are wired independently, the size of the headchip increases.

SUMMARY OF THE INVENTION

The present general inventive concept provides a headchip and a head for an array type inkjet printer in which a power line is wired to share one power line for a plurality of colors to avoid a voltage drop when a plurality of nozzles are driven at the same time, and decreases a size of the headchip.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a headchip usable with an array type inkjet printer, the headchip including an ink supply unit arranged into first nozzle groups and second nozzle groups according to colors, and a power supply unit to supply power to the plurality of first and second nozzle groups in an alternate order, in which the first and second nozzle groups for one color and the first and second nozzle groups for another color closest in proximity to the one color, are connected using one power line.

The power supply unit may be formed in a length direction of the ink supply unit.

The power supply unit may include first and second power pads formed at both ends of the ink supply unit in a length direction to supply power through the power line and a driving signal pad formed between the first and second power pads to supply a driving signal.

The ink supply unit may include a first color, a second color, a third color and a fourth color, and the power supply unit to connect the first nozzle group for the first color with the first nozzle group for the second color, the second nozzle group for the first color with the second nozzle group for the second color, the first nozzle group for the third color with the first nozzle group for the fourth color, and the second nozzle group for the third color with the second nozzle group for the fourth color using one power line, respectively.

The power supply unit may supply power in an alternate order to an even column nozzle group for the first color, an odd column nozzle group for the first color, the even column nozzle group for the third color, and the odd column nozzle group for the third color, and to the even column nozzle group for the second color, the odd column nozzle group for the second color, the even column nozzle group for the fourth color, and the odd column nozzle group for the fourth color.

The foregoing and/or other aspects and utilities of the present general inventive concept may also be achieved by providing a head usable with an array type inkjet printer, the head including an ink cartridge to supply ink, a plurality of headchips spaced away from each other on the ink cartridge, a plurality of substrates in which one end is connected with the headchip, and an other end includes a connection terminal to connect a main body of the array type inkjet printer, and a plurality of bonding units to encapsulate a connection portion between the plurality of substrates and the headchips.

The plurality of substrates may be formed to project the connection terminal outside of the ink cartridge.

The plurality of headchips may include an ink supply unit arranged into first nozzle groups and second nozzle groups according to colors, and a power supply unit to supply power to the plurality of first and second nozzle groups in an alternate order, in which the first and second nozzle groups for one color and the first and second nozzle groups for another color closet in proximity to the one color, are connected using one power line.

The power supply unit may be formed in a length direction of the ink supply unit.

The power supply unit may include first and second power pads formed at both ends of the ink supply unit in a length direction to supply power through the power line, and a driving signal pad formed between the first and second power pads to supply a driving signal.

The ink supply unit may include a first color, a second color, a third color and a fourth color, and the power supply unit to connect the first nozzle group for the first color with the first nozzle group for the second color, the second nozzle group for the first color with the second nozzle group for the second color, the first nozzle group for the third color with the first nozzle group for the fourth color, and the second nozzle group for the third color with the second nozzle group for the fourth color using one power line, respectively.

The power supply unit may supply power in an alternate order to an even column nozzle group for the first color, an odd column nozzle group for the first color, the even column nozzle group for the third color, and the odd column nozzle group for the third color, and to the even column nozzle group for the second color, the odd column nozzle group for the second color, the even column nozzle group for the fourth color, and the odd column nozzle group for the fourth color.

The plurality of headchips may further include a control circuit unit to supply power to only one of the plurality of connected nozzle groups each time, using one power line.

The foregoing and/or other aspects and utilities of the general inventive concept may also be achieved by providing an array head usable with an array-type inkjet printer, the array head including a plurality of headchips having nozzles to discharge ink, a substrate electrically connected to the plurality of headchips through a connection portion and an encapsulation unit to protect the connection portion, wherein a wiping operation is performed in a width direction along a width of the array head.

The foregoing and/or other aspects and utilities of the general inventive concept may also be achieved by providing a head useable with an array type inkjet printer, the head including an ink cartridge, a plurality of headchips spaced apart from each other, arranged in a lengthwise direction of the ink cartridge, and each having a first side parallel to the lengthwise direction, a plurality of substrates connected to the first side of the corresponding headchips and a plurality of bonding unit disposed on the side to encapsulate a portion of the corresponding substrates and headchips.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
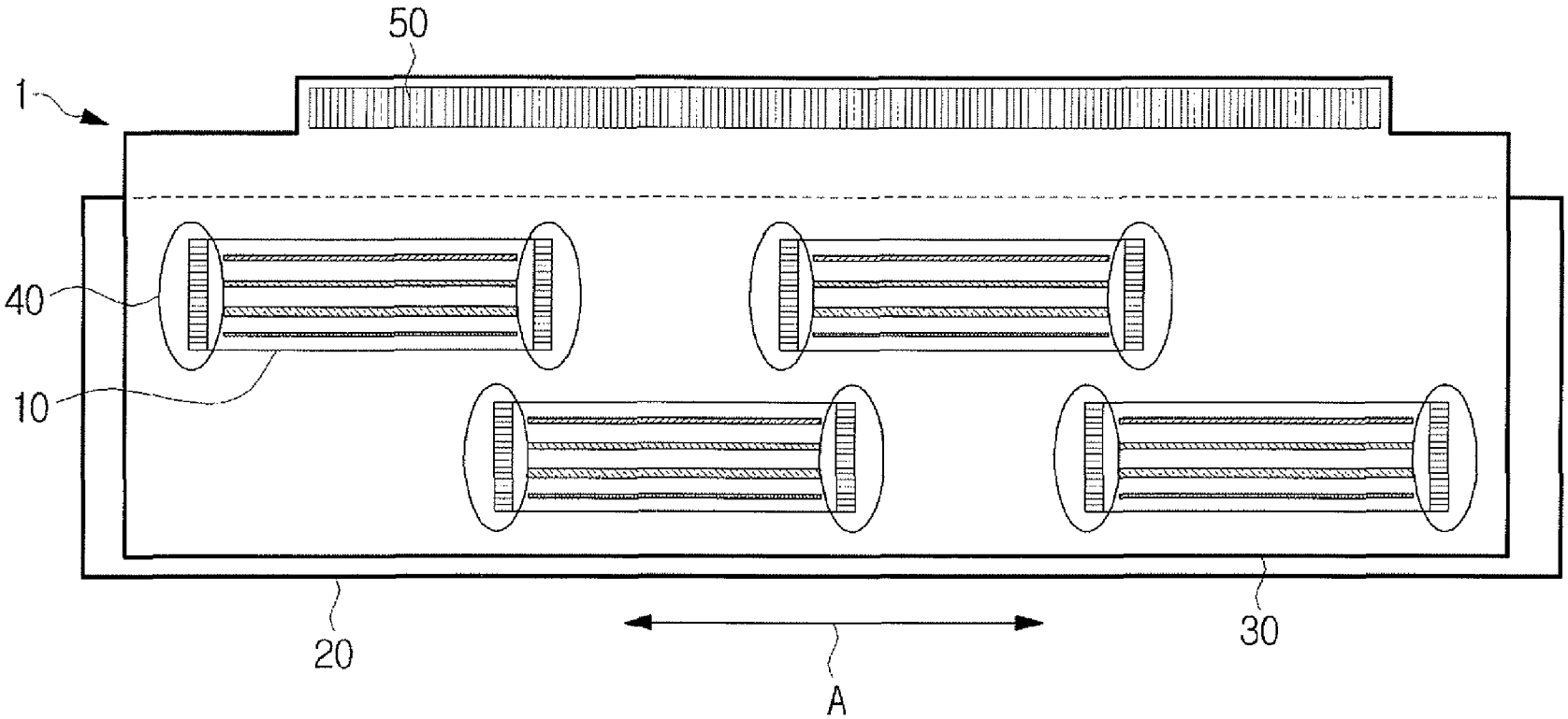
FIG. 1 (RELATED ART)
FIG. 1 is a view illustrating a head structure of a conventional array type inkjet printer.
Figure 2:
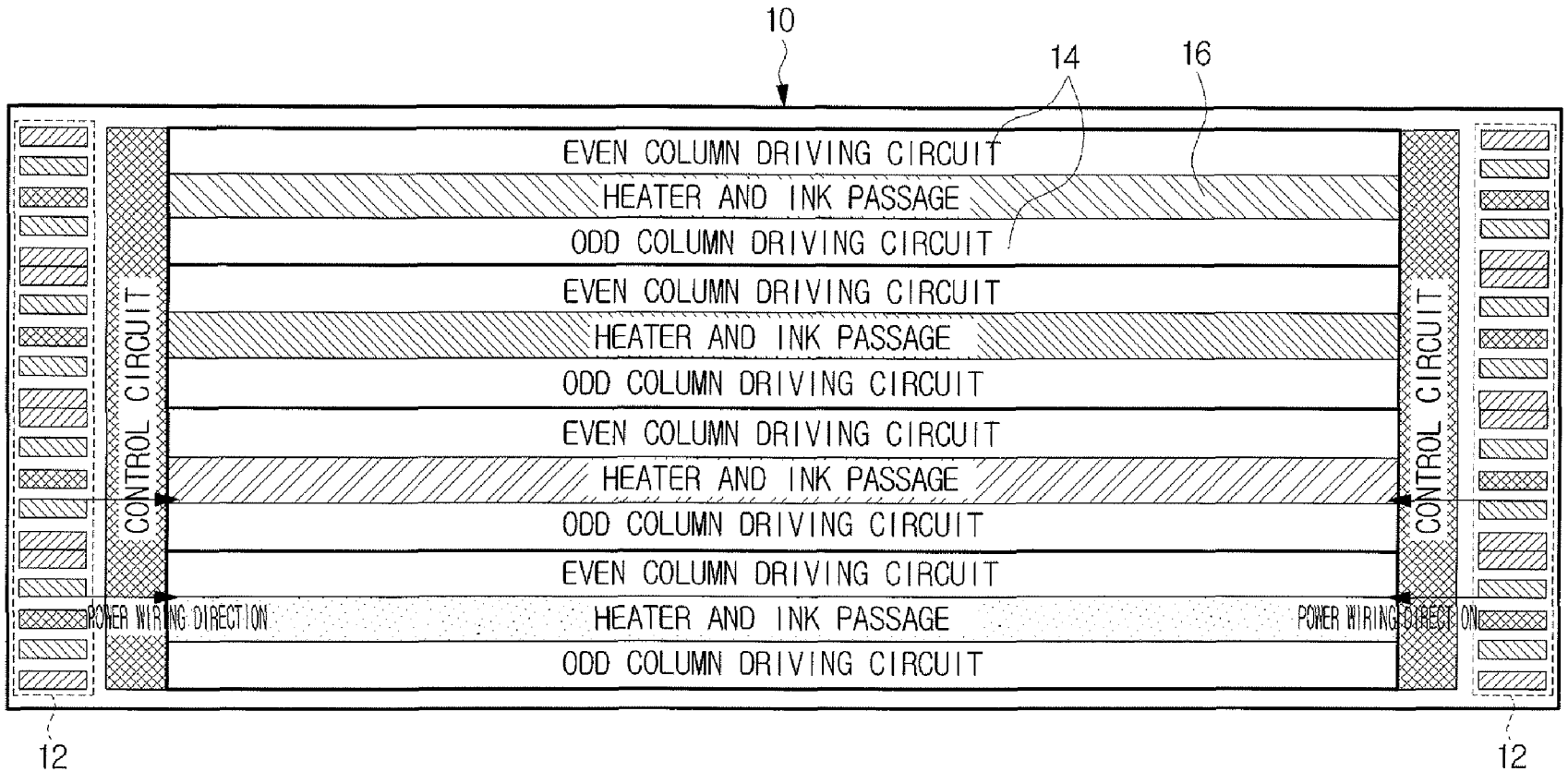
FIG. 2 (RELATED ART)
FIG. 2 is a view illustrating the headchip structure of FIG. 1.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
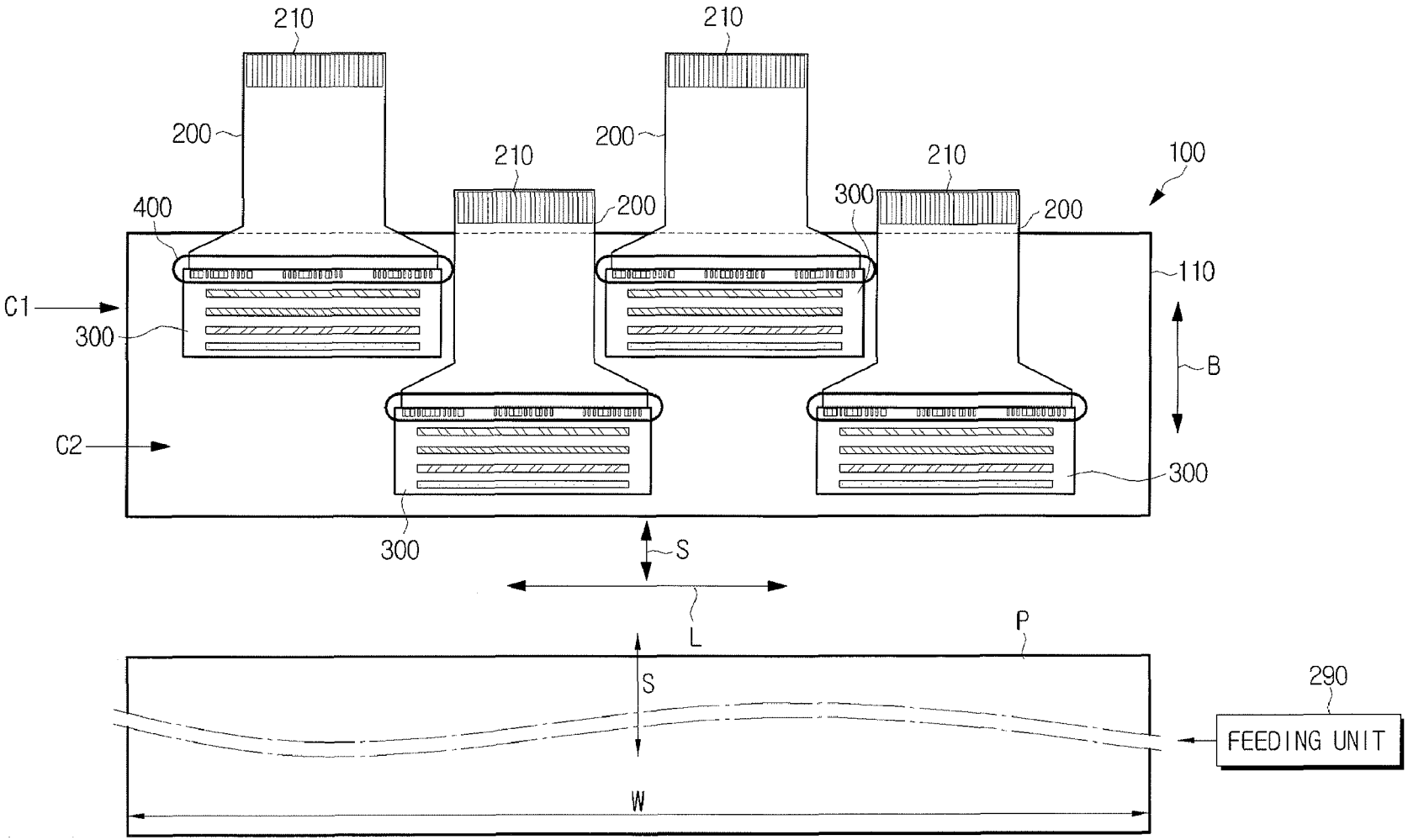
FIG. 3 is a plan view illustrating a head structure of an array type inkjet printer according to an exemplary embodiment of the present general inventive concept.

FIG. 3 is a plan view illustrating a head structure of an array type inkjet printer according to an exemplary embodiment of the present general inventive concept.

Referring to FIG. 3, a head 100 of an array type inkjet printer may include an ink cartridge 110, a plurality of headchips 300, a plurality of substrates 200, and a plurality of bonding units 400. The array type inkjet printer can be exemplified as a color array type inkjet printer, and the color array type inkjet printer has four colors of ink such as Cyan, Magenta, Yellow, and Black (C, M, Y, K), in an exemplary embodiment of the present general inventive concept.

The ink cartridge 110 supplies ink, and can be longer than a width of a printing medium in a scanning direction. That is, printing is performed by moving a cartridge across the width of the printing medium in a shuttle type inkjet printer. However, because printing can be performed with the ink cartridge 110 being fixed in the array type inkjet printer, one line has to be printed at once. Therefore, the ink cartridge 110 can be longer than the width of a printing medium.

The plurality of headchips 300 are spaced away from each other on an upper portion of the ink cartridge 110. A plurality of nozzles to transfer C, M, Y, K inks are provided in the headchip 300. Structure of the headchip 300 will be explained in detail with reference to FIG. 4 which will be explained below.

Referring to FIG. 3, the plurality of headchips 300 are arranged to form two columns C1 and C2 in an alternate order along a scanning direction S on the upper portion of the ink cartridge 110. One of the two columns will be referred to as an even column, and the other one will be referred to as an odd column. Accordingly, the headchips 300 are disposed along a lengthwise direction of the head 100 and/or the ink cartridge to correspond to a width of a printing medium. The printing medium may be fed in the scanning direction S. Each of the headchips 300 has a first side disposed along the lengthwise direction L and a second side disposed along the scanning direction S.

Ends of the plurality of substrates 200 are connected to the plurality of headchips 300, respectively, and connection terminals 210 are provided at other ends of the substrates 200 to connect the plurality of substrates 200 to a main body of the array type inkjet printer. The plurality of substrates 200 may be formed using a Flexible Printed Circuit (FPC), or Printed Circuit Board (PCB), and a substrate of a film type may be used.

Cables (not illustrated) are connected to the connection terminal 210 to connect the main body of the array type inkjet printer and the head 100. Accordingly, power and a driving signal from the main body are transmitted to the headchip 300.

Each of the substrates 200 is connected with the headchip 300, overlapping an upper portion at which a power supply unit of the headchip 300 is formed. One end of each substrate 200, which is connected with the headchip 300, is formed in a similar width as the length of the headchip 300, and the other end of the substrate 200 is formed to project the connection terminal 210 outside of the ink cartridge 110.

One end of the substrate 200 has a similar width as the length of the headchip 300, and the width of the substrate 200 is narrowed from the middle portion so that the other end of the substrate 200 is narrower than the one end of the substrate 200. By doing so, the plurality of headchips 300 formed in two columns are not overlapped by the headchips 300 when the other ends of the substrates 200 at which the connection terminals 210 are formed, are projected outside of the ink cartridge 110.

The plurality of bonding units 400 is formed to protect electrically connection portions of the plurality of substrates 200 and the plurality of headchips 300, respectively. The bonding unit 400 is formed at the connection portions which the plurality of substrates 200 and the plurality of headchips 300 are connected such that the bonding unit 400 protects electrically the connection portions. Accordingly, it may be formed in a length direction of the headchip 300 as illustrated in FIG. 3.

The bonding units 400 are disposed on the first side of the corresponding headchips 300, and the substrates 200 are connected to the first side of the corresponding headchips 300. Each of the substrates 200 is disposed in the scanning directions. The substrates 200 are spaced apart from each other by a distance in the lengthwise direction L. The substrates 200 correspond to one of odd and even columns C1 and C2 and are installed over the ink cartridge 110 and disposed between the adjacent headchips of the other one of the odd and even column C1 and C2. A wiping operation to remove dirt from an upper portion of the headchip 300 may be performed in a perpendicular direction to a direction wherein the bonding unit 400 is formed, that is, to a width direction of the headchip 300. Arrow B indicates the wiping direction in an exemplary embodiment of the present general inventive concept.

A time to perform the wiping operation in the width direction as indicated by the arrow B in FIG. 3 is less than a time to perform the wiping operation in a length direction of the ink cartridge 20 as illustrated in FIG. 1. Thus, the time to perform one wiping operation decreases when it is performed in the width direction rather than the length direction.

Referring to FIG. 3, the plurality of headchips 300 are mounted to the ink cartridge 110, independently from the plurality of substrates 200, respectively. Therefore, the plurality of headchips 300 may be removed and replaced individually.

Figure 4:
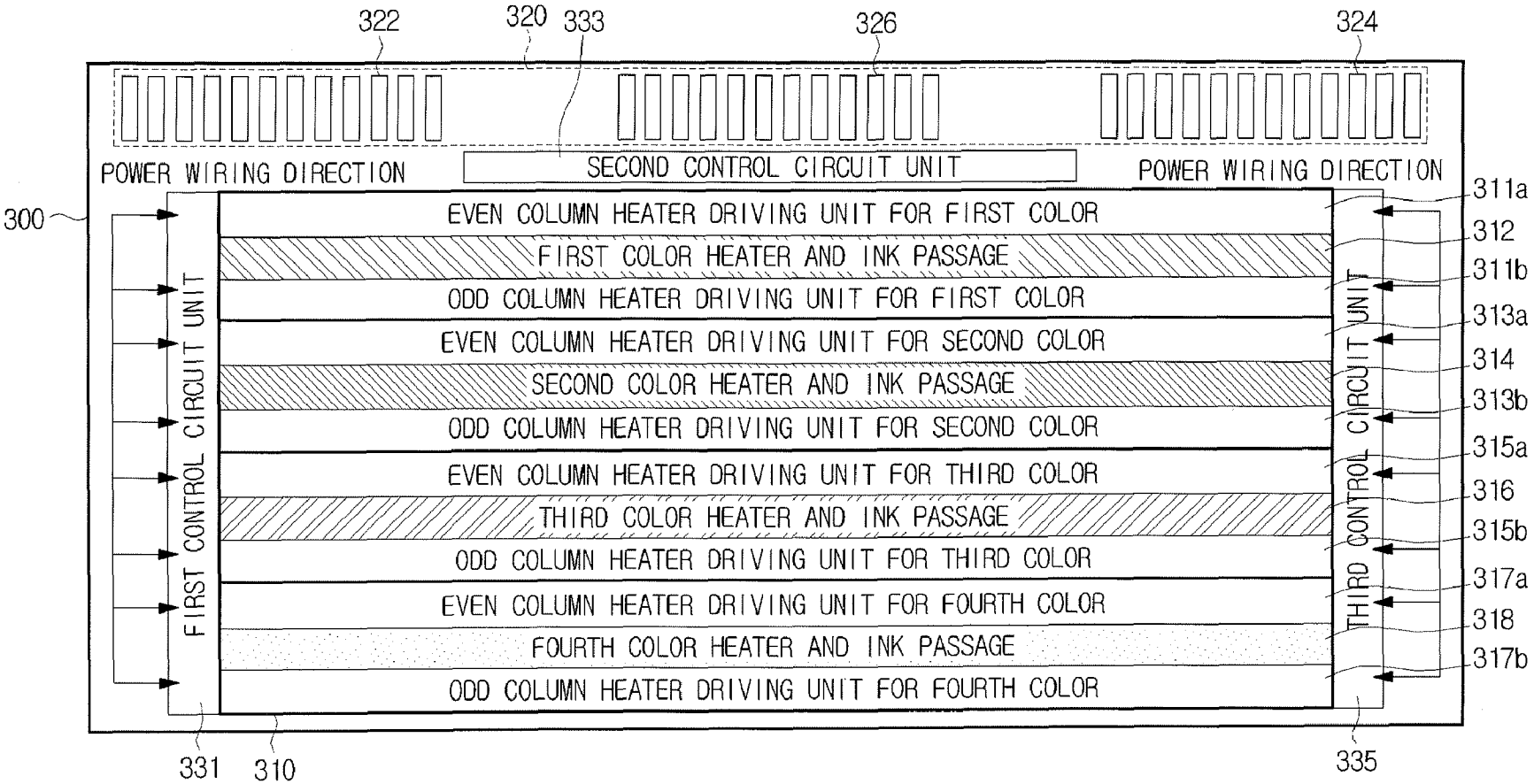
FIG. 4 is a plan view illustrating a headchip structure of an array type inkjet printer according to an exemplary embodiment of the present general inventive concept.

FIG. 4 is a plan view illustrating a headchip structure of an array type inkjet printer according to an exemplary embodiment of the present general inventive concept.

FIG. 4 is a detail view illustrating a structure of the plurality of headchips 300 illustrated in FIG. 3. Referring to FIG. 4, the headchip 300 may include an ink supply unit 310, and a power supply unit 320.

The ink supply unit 310 includes a plurality of nozzles to discharge ink received from the ink cartridge 110. The ink supply unit 310 may include a plurality of ink passages, a plurality of heaters, and a plurality of heater driving units.

The plurality of ink passages may include the plurality of nozzles to discharge the ink received from the ink cartridge 110. As the plurality of heaters heat the ink, the plurality of nozzles of the ink passages discharge the ink. The plurality of nozzles are at predetermined intervals from each other, and are arranged into first and second nozzle groups. The first nozzle group is referred to as an even column, and the second nozzle group is referred to as an odd column for a convenient description, in an exemplary embodiment of the present general inventive concept.

If the array type inkjet printer is a color printer, the ink having C, M, Y, K colors is furnished such that first to fourth color heaters and ink passages 312, 314, 316, 318 are provided in an exemplary embodiment of the present general inventive concept.

The plurality of heater driving units are arranged at both sides of the plurality of ink passages and the plurality of heaters, respectively. That is, a pair of heater driving units is disposed at both sides of the first to fourth color heaters and ink passages 312, 314, 316, 318, respectively, and one of the heater driving units is an even column heater driving unit, and another of the heater driving units is an odd column heater driving unit. The even column heater driving unit drives heaters corresponding to the even column nozzle, and the odd column heater driving unit drives heaters corresponding to the odd column nozzle.

Because the first to fourth color heaters and ink passages 312, 314, 316, 318 are provided, even column heater driving units for the first to fourth colors 311*a*, 313*a*, 315*a*, 317*a*, and odd column heater driving units for the first to fourth colors 311*b*, 313*b*, 315*b*, 317*b* are also provided.

The structure of the ink supply unit 310 including the plurality of ink passages, the plurality of heaters, and the plurality of heater driving units corresponding to the respective colors, will be described in detail in FIGS. 4 and 5 which will be described below.

Referring to FIG. 4, the power supply unit 320 is disposed opposite to one surface which is formed in a length direction of the ink supply unit 310, and supplies power to the ink supply unit 310. The power supply unit 320 includes first and second power pads 322, 324, and a driving signal pad 326.

The first and second power pads 322, 324 are disposed at the both ends of one surface which is formed in a length direction of the ink supply unit 310. The first and second power pads 322, 324 receive power from the main body of the array type inkjet printer, and supply the power to the ink supply unit 310.

The driving signal pad 326 is formed between the first and second power pads 322, 324. The driving signal pad 326 receives a driving signal from the main body of the array type inkjet printer, and supplies the power to the ink supply unit 310. The driving signal supplied through the driving signal pad 326 directs power to the nozzles which are required to discharge ink, among the plurality of nozzles. That is, the driving signal drives the heater corresponding to the nozzle designated to discharge ink.

The power supply unit 320 including the first and second power pads 322, 324 and the driving signal pad 326 is formed opposite to the surface which is formed in a length direction of the ink supply unit 310 in the headchip 300. Accordingly, power wiring between the even column heater driving units for the first to fourth colors 311*a*, 313*a*, 315*a*, 317*a*, and the odd column heater driving units for the first to fourth colors 311*b*, 313*b*, 315*b*, 317*b*, and the power supply unit 320 are arranged to be substantially perpendicular to each other.

The even column heater driving units for the first to fourth colors 311*a*, 313*a*, 315*a*, 317*a*, and the odd column heater driving units for the first to fourth colors 311*b*, 313*b*, 315*b*, 317*b*, connect the even column and the odd column of adjacent different colors using one power line.

That is, the even column nozzle group for the first color and the even column nozzle group for the second color, the odd column nozzle group for the first color and the odd column nozzle group for the second color, the even column nozzle group for the third color and the even column nozzle group for the fourth color, and the odd column nozzle group for the third color and the odd column nozzle group for the fourth color, are connected using one power line, respectively.

The power is wired in a form in which one nozzle group shares one power line for the adjacent two colors. The power wiring is described in detail with reference to FIG. 6 which will be described below.

Figure 6:
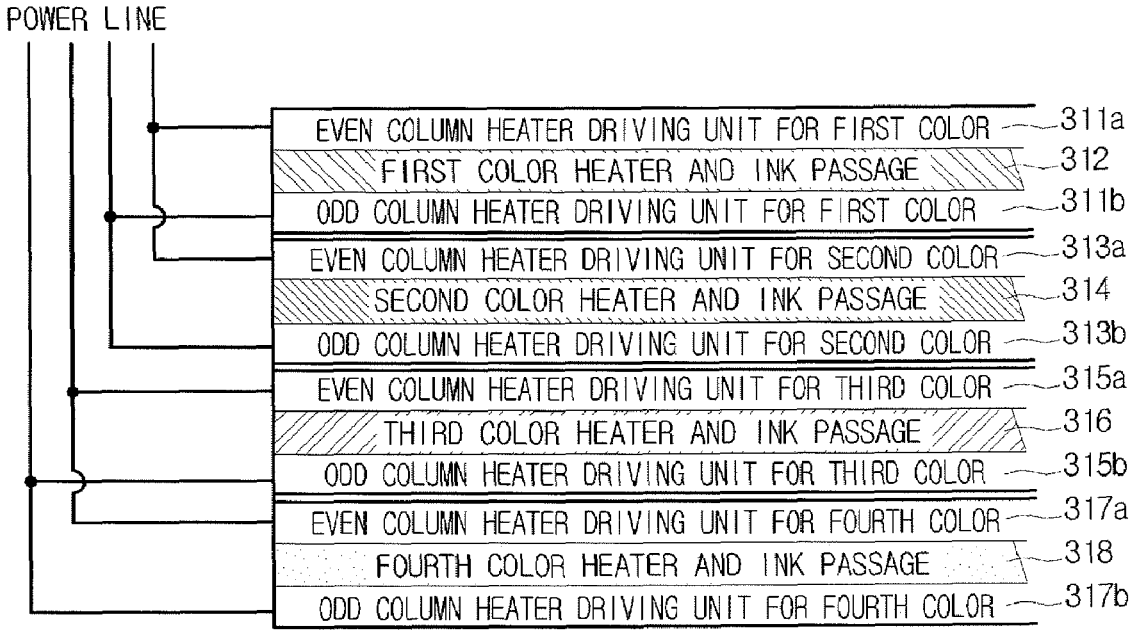
FIG. 6 is a view illustrating a power wiring state of the headchip of FIG. 4.

Referring to FIGS. 4 and 6, according to a connection of the power line, the power supply unit 320 supplies power in an alternate order, to the even column nozzle group for the first color, the odd column nozzle group for the first color, the even column nozzle group for the third color, and the odd column nozzle group for the third color, and to the even column nozzle group for the second color, the odd column nozzle group for the second color, the even column nozzle group for the fourth color, and the odd column nozzle group for the fourth color.

A control circuit unit controls driving of the even column heater driving units for the first to fourth colors 311*a*, 313*a*, 315*a*, 317*a*, and the odd column heater driving units for the first to fourth colors 311*b*, 313*b*, 315*b*, 317*b*.

When the even column heater driving units for the first to fourth colors 311*a*, 313*a*, 315*a*, 317*a*, and the odd column heater driving units for the first to fourth colors 311*b*, 313*b*, 315*b*, 317*b* share one power line, the control circuit unit controls supplying power to only one of the plurality of connected nozzle groups each time, using one power line.

For example, if the heater driving units for the first and second colors share one power line, the control circuit unit controls an operation of either the heater driving unit for the first color or the heater driving unit for the second color.

First and second control circuit units 331, 333 are formed at both ends of the ink supply unit 310, and a third control circuit unit 335 is formed between the power supply unit 320 and the ink supply unit 310 in an exemplary embodiment of the present general inventive concept. However, it is not limited therein.

For example, the third control circuit unit 335 may cover all control operations, and the first and second control circuit units 331, 333 may be omitted. The size of the headchip 300 may decrease, and the size of the head 100 may also decrease.

Figure 5:
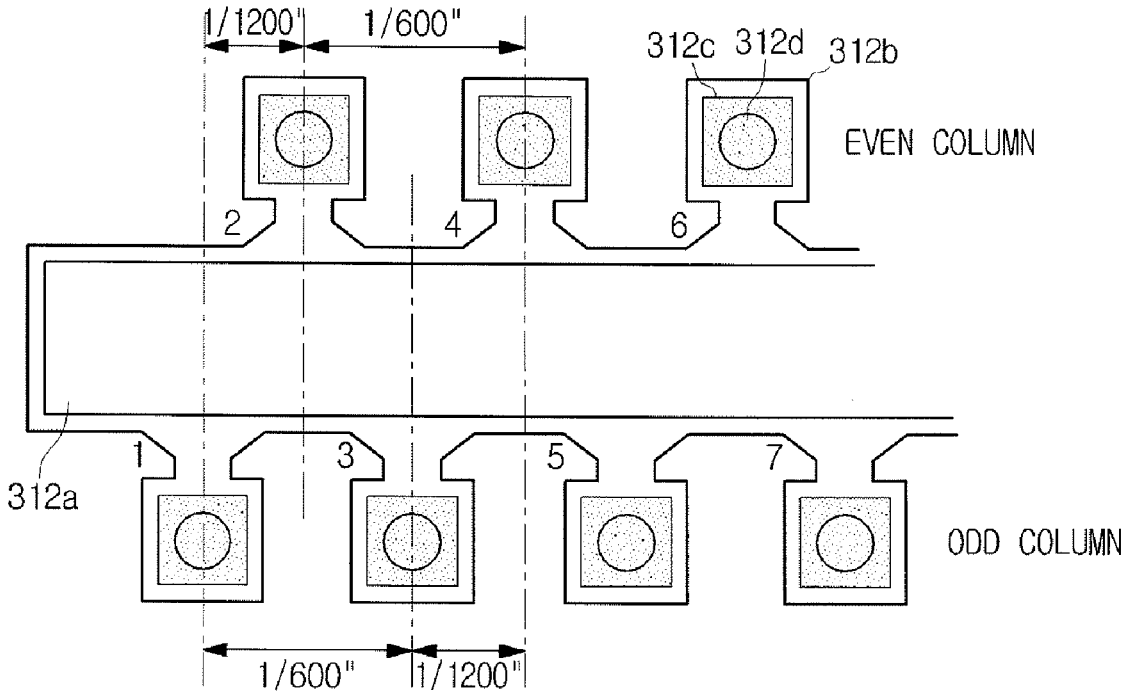
FIG. 5 is a view illustrating a structure of a heater and an ink passage of the headchip illustrated in FIG. 4.

FIG. 5 is a view illustrating a structure of a heater and an ink passage of the headchip illustrated in FIG. 4.

Referring to FIGS. 4 and 5, the structure of the first to fourth color heaters and ink passages 312, 314, 316, 318 is illustrated, and definition of the heaters and ink passages is 1200 dot per inch (dpi) in an exemplary embodiment of the present general inventive concept.

A hole is formed at the rear of the headchip 300 to receive ink from the ink cartridge 110. The hole formed at the rear of the headchip 300 is referred to as an ink supply hole 312*a*.

An ink chamber 312*b*, a heater 312*c*, and a nozzle 312*d* are formed at both sides of the ink supply hole 312*a*. The ink chamber 312*b* receives the ink from the ink supply hole 312*a*, and stores the ink to be discharged through each nozzle 312*d*. The heater 312*c* receives a pulse from the heater driving unit, expands the ink by heating the ink instantly, and discharges the ink using the pressure generated by the expansion. The nozzle 312*d* discharges the expanded ink in response to the pressure to the desired direction.

As illustrated in FIG. 5, the nozzle 312*d* is arranged above and below of the ink supply hole 312*a*. If the first nozzle is referred to as nozzle 1, the nozzles at the upper portion of the ink supply hole 312*a* are referred to as the even column nozzles (nozzles 2, 4, 6), and the nozzles at the bottom portion of the ink supply hole 312*a* are referred to as the odd column nozzles (nozzles 1, 3, 5, 7). That is, the even nozzles 2, 4, 6, and so on belong to the first nozzle group, and the odd nozzles 1, 3, 5, 7, and so on belong to the second nozzle group.

If the structure of the nozzle 312*d* illustrated in FIG. 5 corresponds to a structure of the first color heater and ink passage 312 of FIG. 4, the even column heater driving unit for the first color 311*a* drives the heater corresponding to the even column nozzles (nozzles 2, 4, 6), and the odd column heater driving unit for the first color 311*b* drives the heater corresponding to the odd column nozzle (nozzles 1, 3, 5, 7).

FIG. 6 is a view illustrating a power wiring state of the headchip of FIG. 4.

The even column heater driving units for the first to fourth colors 311*a*, 313*a*, 315*a*, 317*a*, and the odd column heater driving units for the first to fourth colors 311*b*, 313*b*, 315*b*, 317*b* are connected with the even column and the odd column of adjacent different colors using one power line, respectively. That is, power lines are wired in a form that the even column nozzle and the odd column nozzle of the adjacent two colors share one power line, respectively.

Referring to FIG. 6, power lines are wired in the form of sharing a power line between the even column heater driving unit for the first color 311*a* and the even column heater driving unit for the second color 313*a*, between the odd column heater driving unit for the first color 311*b* and the odd column heater driving unit for the second color 313*b*, between the even column heater driving unit for the third color 315*a* and the even column heater driving unit for the fourth color 317*a*, and between the odd column heater driving unit for the third color 315*b* and the odd column heater driving unit for the fourth color 317*b*.

Referring to FIGS. 4 and 6, the power lines are formed in a form in which the left and right power lines are symmetrical to each other based on a center portion of the headchip 300, and power lines are wired through an edge of the left and right sides of the headchip 300 from the power supply unit 320 which is formed at the upper portion of the headchip 300.

If the power lines are independently wired according to the respective colors, the plurality of first and second power pads 322, 324, and the plurality of driving signal pads 326 are required, and more space is required to wire the power lines. Therefore, the size of the headchip 300 increases. However, two colors sharing one power line in an exemplary embodiment of the present general inventive concept does not require more space to wire the power lines. Accordingly, in an exemplary embodiment, the size of the headchip 300 does not increase.

If the four colors share one power line, as more nozzles are driven at the same time, a drop of the voltage transmitted to the respective heaters occurs more frequently due to parallel resistance effect. Alternatively, two colors may share one power line as in an exemplary embodiment of the present general inventive concept.

Figure 7:
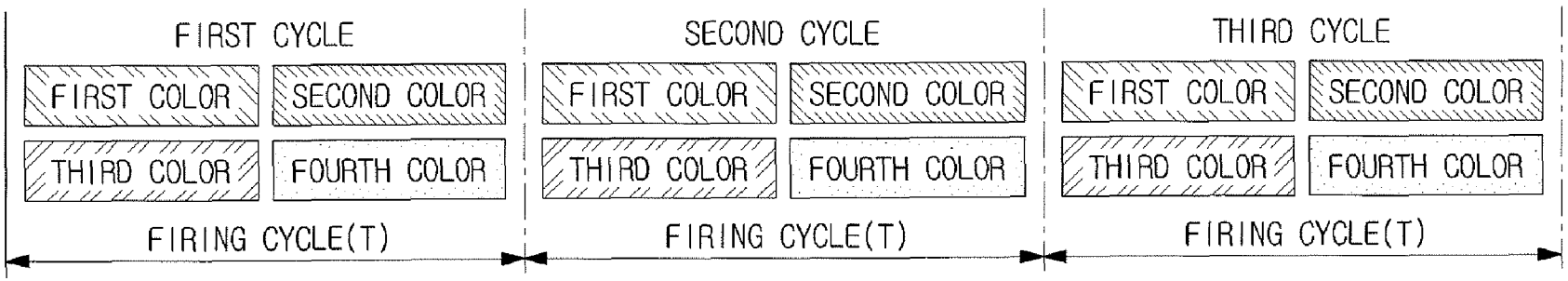
FIG. 7 is a view illustrating a method of driving each color in the power wiring state of FIG. 6.
Figure 8:
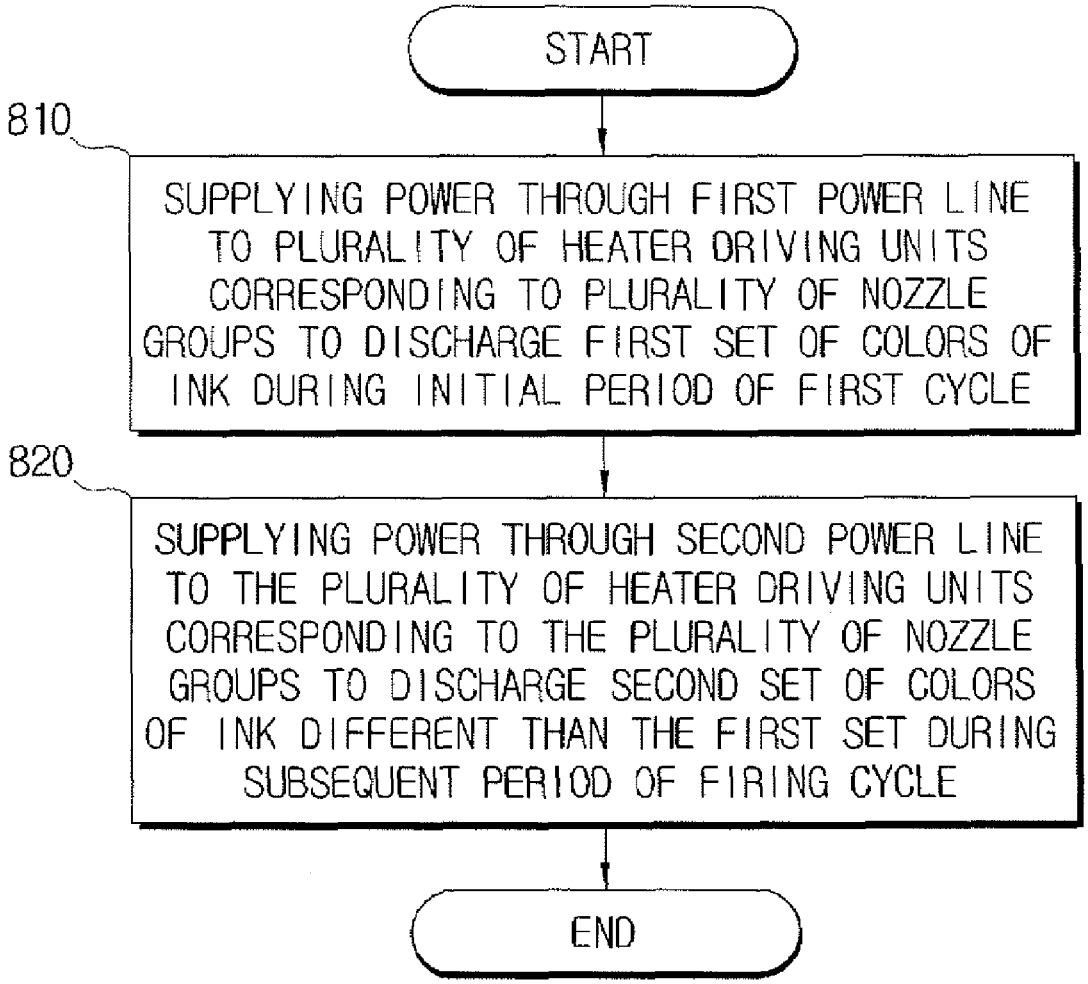
FIG. 8 is a flowchart illustrating a method of multi-color inkjet printing according to an exemplary embodiment of the present general inventive concept.

FIG. 7 is a view illustrating a method of driving each color in the power wiring state of FIG. 6, and FIG. 8 is a flowchart illustrating a method of multi-color inkjet printing according to an exemplary embodiment of the present general inventive concept. Referring to FIG. 8, in operation 810, power is supplied through a first power line to a plurality of heater driving units corresponding to a plurality of nozzle groups to discharge a first set of colors of ink during an initial period of a firing cycle. In operation 820, power is supplied through a second power line to the plurality of heater driving units corresponding to the plurality of nozzle groups to discharge a second set of colors of ink different than the first set during a subsequent period of the firing cycle.

Referring to FIG. 6, if the power lines are wired such that the first and second colors share one power line, and the third and fourth colors share one power line, the first and third colors may be driven at the same time, and the second and fourth colors may be driven at the same time, at each cycle. However, because the first and second colors, or the third and fourth colors share power line, the first and second colors, or the third and fourth colors are not driven at the same time.

As colors not sharing one power line are driven at the same time, a voltage drop is avoided which would otherwise occur if all colors share one power line. An interval between the respective cycles may be an ink firing cycle (T) of each nozzle, and firing of nozzles of each color is completed within half the time of the ink firing cycle (T).

For example, it is supposed that the first to fourth colors have nozzle #1 to nozzle #100. The ink firing cycle (T) refers to a duration from when nozzle #1 to nozzle #100 of the first and third colors are started, until when an operation of nozzle #1 to nozzle #100 of the second and fourth colors is terminated. That is, the ink firing cycle (T) refers to a time point when an operation of two hundreds nozzles is terminated, from an operation starting point of nozzle #1 of the first and third colors, to an operation ending point of nozzle #100 of the second and fourth colors.

When the transfer is terminated in the first transfer cycle, nozzles of the first and third colors are operated in the second transfer cycle, and subsequently nozzles of the second and fourth colors are operated. The operations are reiterated in three, four, or more cycles.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, various embodiments of the present general inventive concept provides that a headchip and a head of an array type inkjet printer have power wiring in which a power line is shared among a plurality of nozzles according to a plurality of colors. As a result, power consumption and voltage drop may be reduced although the plurality of nozzles according to the each color are operated at the same time.

Furthermore, a substrate connecting a headchip and a main body of each headchip is provided in a separated structure such that the headchip may be replaced individually, and a user may easily deal with defectiveness of the headchip.

As the connection portion of the headchip and the substrate is formed at the upper end of the headchip, a wiping operation is performed in a width direction of the headchip. As a result, time for the wiping operation is reduced, and printing speed is improved.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A headchip usable with an array type inkjet printer, the headchip comprising:

an ink supply unit arranged into first nozzle groups and second nozzle groups according to colors; and a power supply unit to supply power to the plurality of first and second nozzle groups in an alternate order, in which the first and second nozzle groups for one color and the first and second nozzle groups for another color closest in proximity to the one color, are connected using one power line.

2. The headchip as claimed in claim 1, wherein the power supply unit is formed in a length direction of the ink supply unit.

3. The headchip as claimed in claim 1, wherein the power supply unit comprises:

first and second power pads formed at both ends of the ink supply unit in a length direction to supply power through the power line; and a driving signal pad formed between the first and second power pads to supply a driving signal.

4. The headchip as claimed in claim 1, wherein the ink supply unit comprises:

a first color, a second color, a third color and a fourth color; and the power supply unit to connect the first nozzle group for the first color with the first nozzle group for the second color, the second nozzle group for the first color with the second nozzle group for the second color, the first nozzle group for the third color with the first nozzle group for the fourth color, and the second nozzle group for the third color with the second nozzle group for the fourth color using one power line, respectively.

5. The headchip as claimed in claim 4, wherein:

the power supply unit supplies power in an alternate order to an even column nozzle group for the first color, an odd column nozzle group for the first color, the even column nozzle group for the third color, and the odd column nozzle group for the third color, and to the even column nozzle group for the second color, the odd column nozzle group for the second color, the even column nozzle group for the fourth color, and the odd column nozzle group for the fourth color.

6. A head usable with an array type inkjet printer, the head comprising:

an ink cartridge to supply ink;

a plurality of headchips spaced away from each other on the ink cartridge;

a plurality of substrates in which one end is connected with the headchip, and an other end includes a connection terminal to connect a main body of the array type inkjet printer; and a plurality of bonding units to encapsulate a connection portion between the plurality of substrates and the headchips.

7. The head as claimed in claim 6, wherein the plurality of substrates are formed to project the connection terminal outside of the ink cartridge.

8. The head as claimed in claim 6, wherein the plurality of headchips comprise:

an ink supply unit arranged into first nozzle groups and second nozzle groups according to colors; and a power supply unit to supply power to the plurality of first and second nozzle groups in an alternate order, in which the first and second nozzle groups for one color and the first and second nozzle groups for another color closet in proximity to the one color, are connected using one power line.

9. The head as claimed in claim 8, wherein the power supply unit is formed in a length direction of the ink supply unit.

10. The head as claimed in claim 9, wherein the power supply unit comprises:

first and second power pads formed at both ends of the ink supply unit in a length direction to supply power through the power line; and a driving signal pad formed between the first and second power pads to supply a driving signal.

11. The head as claimed in claim 8, wherein the ink supply unit comprises:

a first color, a second color, a third color and a fourth color; and the power supply unit to connect the first nozzle group for the first color with the first nozzle group for the second color, the second nozzle group for the first color with the second nozzle group for the second color, the first nozzle group for the third color with the first nozzle group for the fourth color, and the second nozzle group for the third color with the second nozzle group for the fourth color using one power line, respectively.

12. The head as claimed in claim 11, wherein the power supply unit supplies power in an alternate order to an even column nozzle group for the first color, an odd column nozzle group for the first color, the even column nozzle group for the third color, and the odd column nozzle group for the third color, and to the even column nozzle group for the second color, the odd column nozzle group for the second color, the even column nozzle group for the fourth color, and the odd column nozzle group for the fourth color.

13. The head as claimed in claim 8, wherein the plurality of headchips further comprise:

a control circuit unit to supply power to one of the plurality of connected nozzle groups each time, using one power line.

14. A head useable with an array type inkjet printer, the head comprising:

an ink cartridge;

a plurality of headchips spaced apart from each other, arranged in a lengthwise direction of the ink cartridge, and each having a first side parallel to the lengthwise direction;

a plurality of substrates connected to the first side of the corresponding headchips; and a plurality of bonding unit disposed on the side to encapsulate a portion of the corresponding substrates and headchips.

15. The headchip as claimed in claim 14, wherein the plurality of headchips comprise:

a first column of headchips disposed on a first column line along the lengthwise direction and a second column of the headchips disposed on a second column line along the lengthwise direction; and the substrates are connected to the first side of the corresponding ones of the first and second columns of the headchips.

16. The headchip as claimed in claim 14, wherein:

the substrates are spaced apart from each other to be connected to the first side of the corresponding headchips.

17. The headchip as claimed in claim 14, wherein the plurality of headchips comprise:

a second side perpendicular to one of the first side and the lengthwise direction; and the substitutes are not connected to the second side of the corresponding headchips.

18. The headchip as claimed in claim 14, wherein the headchips comprise:

a first column of head chips and a second column of headchips; and the substrates comprise:

first substrates having a first length and second substrates having a second length to be connected to corresponding ones of the first and second columns of headchips.

* * * * *